US006308022B1

(12) United States Patent
Sasai

(10) Patent No.: US 6,308,022 B1
(45) Date of Patent: Oct. 23, 2001

(54) IMAGE FORMING APPARATUS AND WARMING UP METHOD

(75) Inventor: Takahiro Sasai, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/602,676

(22) Filed: Jun. 26, 2000

(30) Foreign Application Priority Data

Jul. 12, 1999 (JP) ..... 11-197406

(51) Int. Cl.[7] ..... G03G 15/20
(52) U.S. Cl. ..... 399/70
(58) Field of Search ..... 399/67, 69, 70, 399/320, 328, 335; 347/156

(56) References Cited

U.S. PATENT DOCUMENTS 4,745,436 * 5/1988 Matsuura ..... 399/70
5,109,255 * 4/1992 Nishikawa et al. ..... 399/70
5,280,328 * 1/1994 Goto et al. ..... 399/70
5,489,935 * 2/1996 Dornier ..... 399/70 X
5,694,226 * 12/1997 Yokoyama ..... 399/69 X
5,729,789 * 3/1998 Tamaki ..... 399/70
5,897,242 * 4/1999 Hosoi ..... 399/70
5,899,599 * 5/1999 Kato ..... 399/69

FOREIGN PATENT DOCUMENTS 04-250484 9/1992 (JP) .

* cited by examiner

*Primary Examiner*—Sandra Brase
(74) *Attorney, Agent, or Firm*—Hogan & Hartson, L.L.P.

(57) ABSTRACT

A warm-up completion temperature (temp 2) of an electrophotographic type printer is set to be lower than a stand-by temperature (temp 3). When a temperature detector detects that a temperature of a fuser reaches the warm-up completion temperature, then a controller ends the warm-up operation. The warm-up time between the turning on of power and the completion of the machine's warm-up operation is thus reduced. An amount of power required for the warm-up operation is also reduced.

18 Claims, 5 Drawing Sheets

IMAGE FORMING APPARATUS AND WARMING UP METHOD

BACKGROUND OF THE INVENTION

1. Field of the Invention

The present invention relates to an electro-photographic type image forming apparatus and a method of warming up the image forming apparatus.

2. Description of the Related Art

When power is turned on in an electro-photographic type image forming apparatus, the apparatus performs a warm-up operation (forwardly rotating a photosensitive drum, and raising the temperature of a fuser. The warm-up operation continues until the fuser reaches a certain stand-by temperature.

However, it may take a long time for the fuser to reach the stand-by temperature during the warm up operation. This generally results in having to wait for a long time before the apparatus can begin printing. Consequently, the user has to wait for a long time until the printing out is complete.

SUMMARY OF THE INVENTION

It is thus an object of the present invention to provide an image processing apparatus capable of reducing the warm up period.

In order to accomplish this object, according to one aspect of the present invention, an electro-photographic type image processing apparatus includes a heating unit that heats a fuser, a detection unit that detects the temperature of the fuser, and a control unit that stops performing the warm-up operation when the fuser reaches a warm up completion temperature that is lower than the stand-by temperature. Since the warm up operation is terminated at a temperature lower than the stand-by temperature, the warm-up period of the image forming apparatus can be reduced. The conventional image forming apparatus stops the warm up operation when the fuser temperature reaches the stand-by temperature.

The control unit may heat the fuser to the stand-by temperature after the fuser reaches the warm up completion temperature. Accordingly, it is possible to heat the fuser unit to the fusing temperature in a relatively short period. Therefore, even if a start key is pressed while the image forming apparatus is in a stand-by condition, the fuser unit is heated to the fusing temperature before the recording paper reaches the fusing unit, whereby printing can be reliably enabled.

The control unit may cause the heating unit to heat the fuser such that the temperature of the fuser becomes the fusing temperature in the period of time between the receiving of a print command signal and the moment the front end of the recording paper reaches the fuser. Accordingly, the fuser is brought into a "printing ready" condition. Thus, the transferred toner image can be reliably fused/fixed on the recording paper.

According to another aspect of the present invention, there is provided an image forming device including a photosensitive body, an exposure unit that forms an electrostatic latent image on the photosensitive body, a developer that forms a toner image by applying toner to the electrostatic latent image, a transfer that transfers the toner image onto a recording sheet, a fuser that fuses/fixes the transferred image onto the recording sheet, a heater that heats the fuser, a temperature detector that detects the temperature of the fuser, and a controller that adjusts the heater based on the temperature detected by the temperature detector, wherein the controller ends a warm-up operation when the detected fuser unit temperature reaches a warm-up completion temperature that is lower than a stand-by temperature. This arrangement also reduces the length of the warm-up period.

In the detailed description, the heating unit is embodied as a heat lamp 101*a*, the temperature detection unit is embodied as a temperature sensor 110, and the control unit is embodied as MPU 11, ROM 12, and RAM 13.

BRIEF DESCRIPTION OF THE DRAWINGS

FIG. 4 is a flow chart showing the operation of the fax machine of FIG. 1 after power is turned on.

DETAILED DESCRIPTION OF THE INVENTION

An embodiment of the image forming apparatus of the present invention will now be described with reference to the accompanying drawings. This embodiment will describe the image forming apparatus as a facsimile machine 1.

Figure 1:
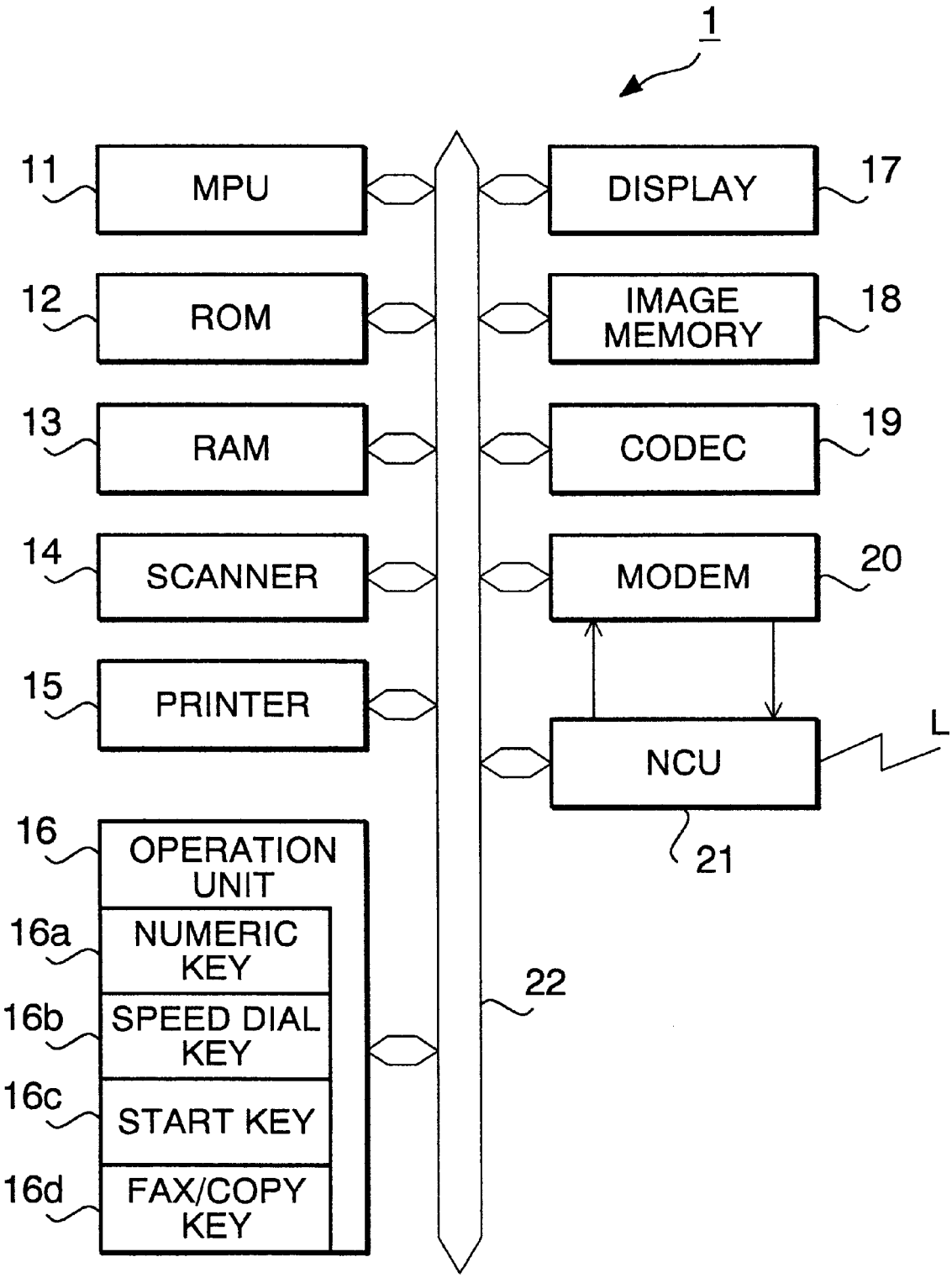
FIG. 1 is block diagram showing a facsimile machine according to the present invention.

As shown in FIG. 1, the facsimile machine 1 includes MPU 11, ROM 12, RAM 13, scanning unit 14, printing unit 15, operating unit 16, display unit 17, image memory 18, CODEC 19, modem 20, and NCU 21. These elements 11~21 are interconnected over BUS 22.

MPU 11 controls the various elements of the machine 1, and ROM 12 stores programs used to control the machine 1. RAM 13 temporarily stores data used by the machine 1.

Scanning unit 14 scans a document and outputs it as binary (black and white) image data. Printing unit 15 is comprised as an electro-photographic type printer, and is capable of printing out onto a recording sheet image data received from a remote location, and image data of a document scanned by the scanning unit 14 for copying. The printing unit 15 will be described in greater detail hereinbelow.

Operating unit 16 contains various keys that allow the user to operate the machine. These keys and controls include a numeric key pad 16*a* (including # and * keys) to allow input of telephone and facsimile numbers, a one-touch/quick-dial key 16*b* to allow a user to register and input telephone and fax numbers using a quick dial number, a start key 16*c* through which the user can initiate scanning of a document, and a transmit/copy key 16*d* to switch the machine 1 between fax transmission and copying.

Display unit 17 includes an LCD or the like, and indicates the operating status of the machine 1, as well as various other information.

Image memory 18 temporarily stores image data received from a remote source, or image data scanned by the scanning unit 14. CODEC 19 encodes the image data for transmission that is scanned by the scanning unit using an appropriate encoding method, such as MH, MR, MMR, or the like, and also decodes image data received from a remote source.

Modem 20 modulates and demodulates data that is sent or received according to V.17, V.27ter, V.29 or the like, based on ITU-T recommendation T.30 facsimile transmission procedures. NCU 21 controls the establishment and breakage of connection with a telephone line L, sends dialing signals corresponding to remote fax numbers, and detects arrival of a call from a remote source.

The operation of the printing unit 15 will now be described in detail.

Figure 2:
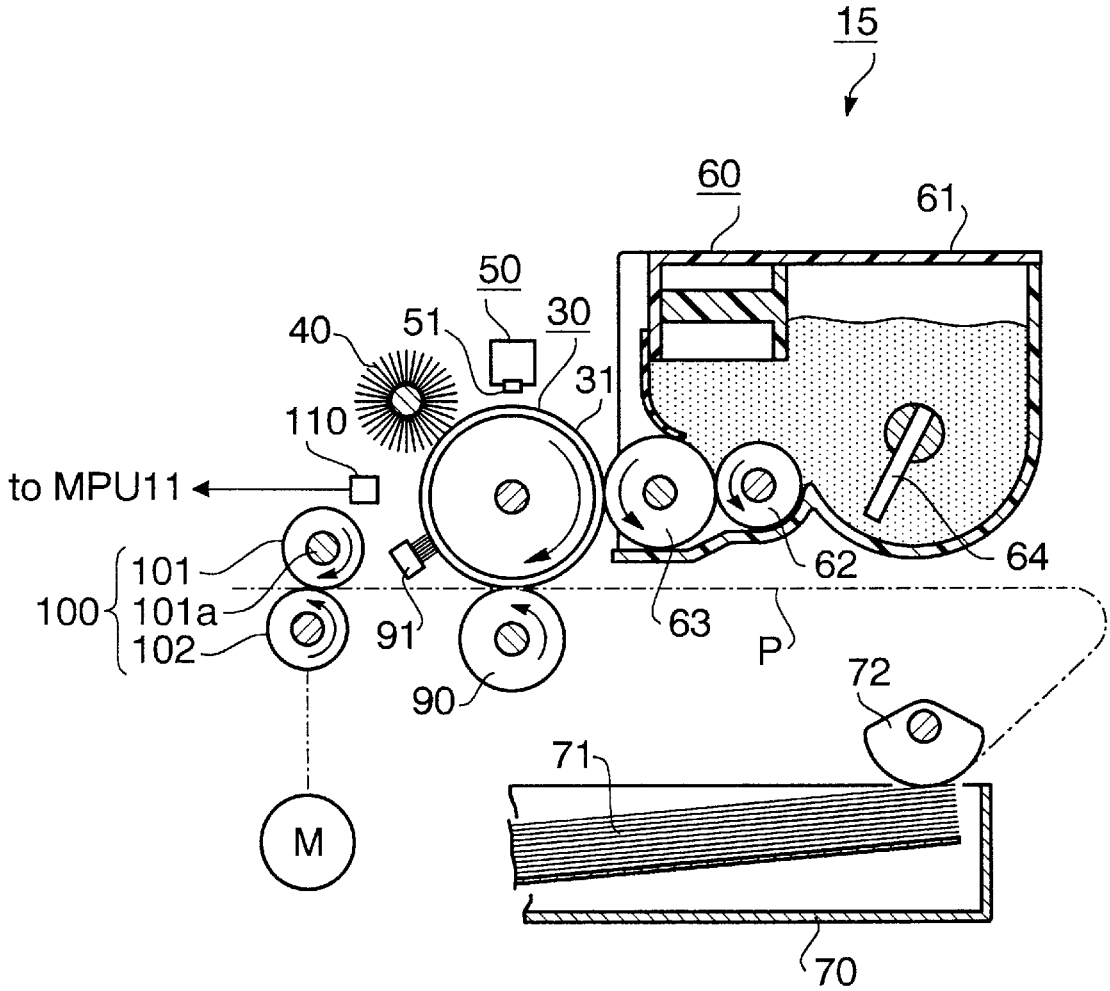
FIG. 2 is a cross-section view of a record unit of the facsimile machine shown FIG. 1.

As shown in FIG. 2, a photosensitive drum 30 is held by its axial shaft such that the drum 30 is rotatable. Photoconductive film 31 is laid over the outer surface of the photosensitive member 30.

A charger 40, formed as a brush roller made of electroconductive fiber, uniformly charges the photo-conductive film 31 on the drum 30 to a predetermined electric potential. Exposure unit 50, formed as an LED array 51, radiates light at the photo-conductive film 31 creating an electrostatic latent image on the photosensitive drum 30.

Developer unit 60 is provided with a toner case 61 that holds toner, a supply roller 62 that is supplied with a predetermined voltage and arranged in the bottom portion of the toner case 61, and a developing roller 63, also supplied with a predetermined voltage and arranged in an opening at the bottom of the toner case 61 between the supply roller 62 and photosensitive drum 30. The toner, which is transported from the toner case 61 by the supply roller 62 and developing roller 63, and which is charged to a predetermined polarity, is selectively applied to the electrostatic latent image based on the polarity of the toner and the difference in electrical potential between the developing roller 63 and the electrostatic latent image formed on the photosensitive drum 30. The toner that adheres to the electro-static latent image thus forms a toner image on the drum 30.

A stirrer 64 is rotatably held inside the toner case 61. Rotation of the stirrer 64 agitates the toner inside the toner case 61, maintaining the toner at a uniform consistency.

Paper cassette 70 is capable of holding stacked sheets of recording paper 71 of a predetermined size. Semi-circular roller 72 feeds out the upper most sheet 71 from the stack of paper stored in the paper cassette 70 one sheet at a time. The sheet that is fed out 71 is transported towards the photosensitive drum 30. The paper 71 follows the path indicated in the drawing by the chain-dotted line P.

A transfer unit 90 is arranged below the photosensitive drum 30, and is controlled at a predetermined electrical potential. The difference in electrical potential between the transfer unit 90 and the photosensitive drum 30 causes the toner image to be transferred from the photosensitive drum to the paper 71.

Memory removing brush 91 is formed as an electrically conductive brush, and brushes any toner remaining on the photosensitive drum 30 after transfer such that the toner is uniformly dispersed on the photosensitive drum 30.

Fuser unit 100 includes a heat roller 101 and a nip roller 102, and is arranged downstream (in the direction of paper passage) from the photosensitive drum 30. A lamp 101*a* (a halogen lamp, for example) is arranged inside the heat roller 101 to maintain the fuser unit 100 at a predetermined temperature. The fuser unit 100 melts the toner and fuses/fixes it to the paper 71 when the paper 71 is passed between the heating roller 101 and the nip roller 102.

A temperature sensor 110 is arranged in proximity to the fuser 100. The temperature sensor 110 is connected to MPU 11. The sensor detects the temperature of the fuser 100, and outputs the detected temperature to the MPU 11.

A motor M serves as the drive source for the printing unit 15, driving the supply roller 62, developing roller 63, and other various rollers. As in the present embodiment, the motor M may drive the entire facsimile machine 1. It should further be noted that in the present embodiment, the charging of the photosensitive drum, exposure, development, image transfer, and fusing processes are all performed sequentially, and constitute in combination a "printing process."

Figure 3:
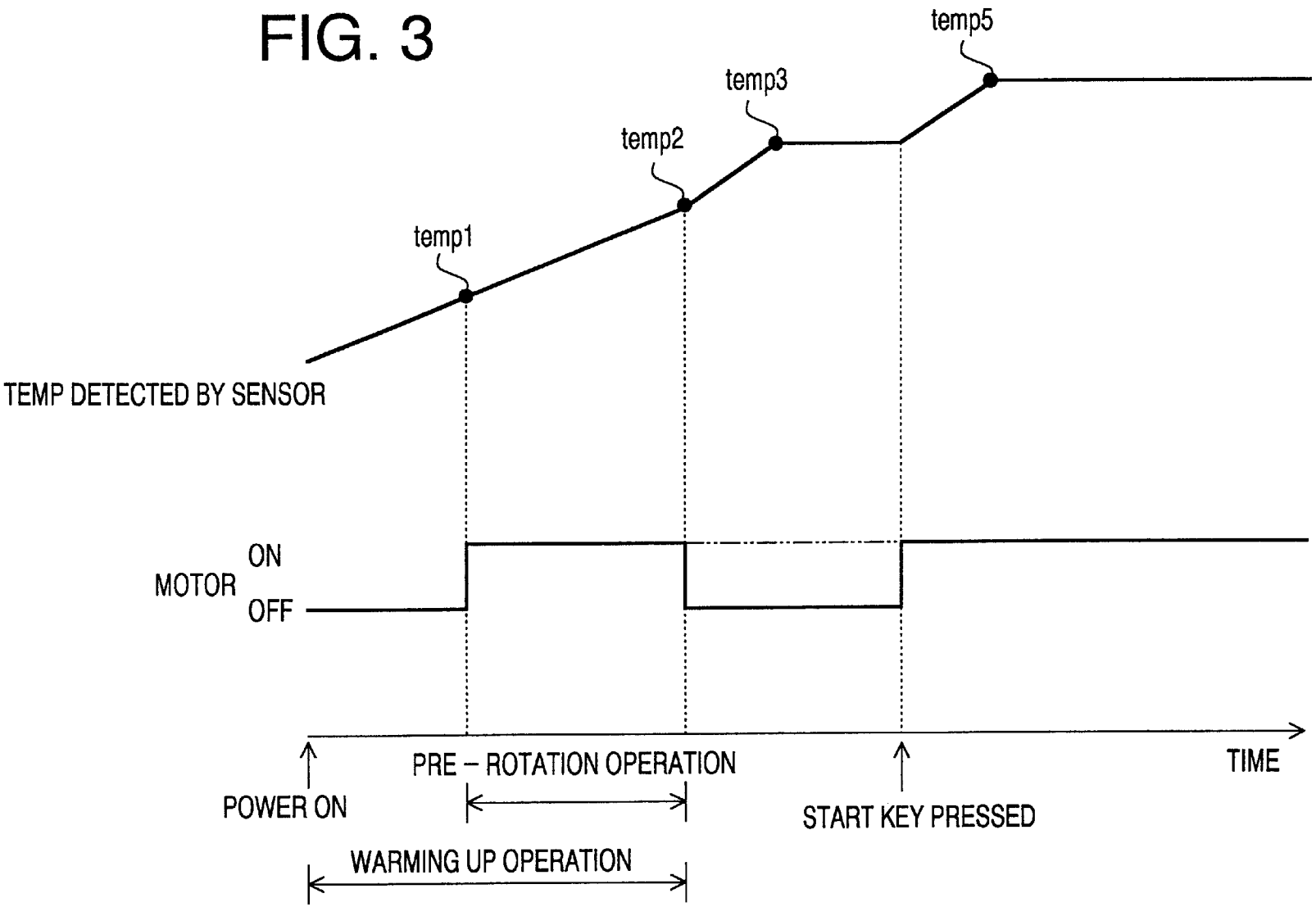
FIG. 3 is a time line showing the relationship between motor operation and detected temperature from the time power is turned on in the fax machine of FIG. 1.
Figure 4:
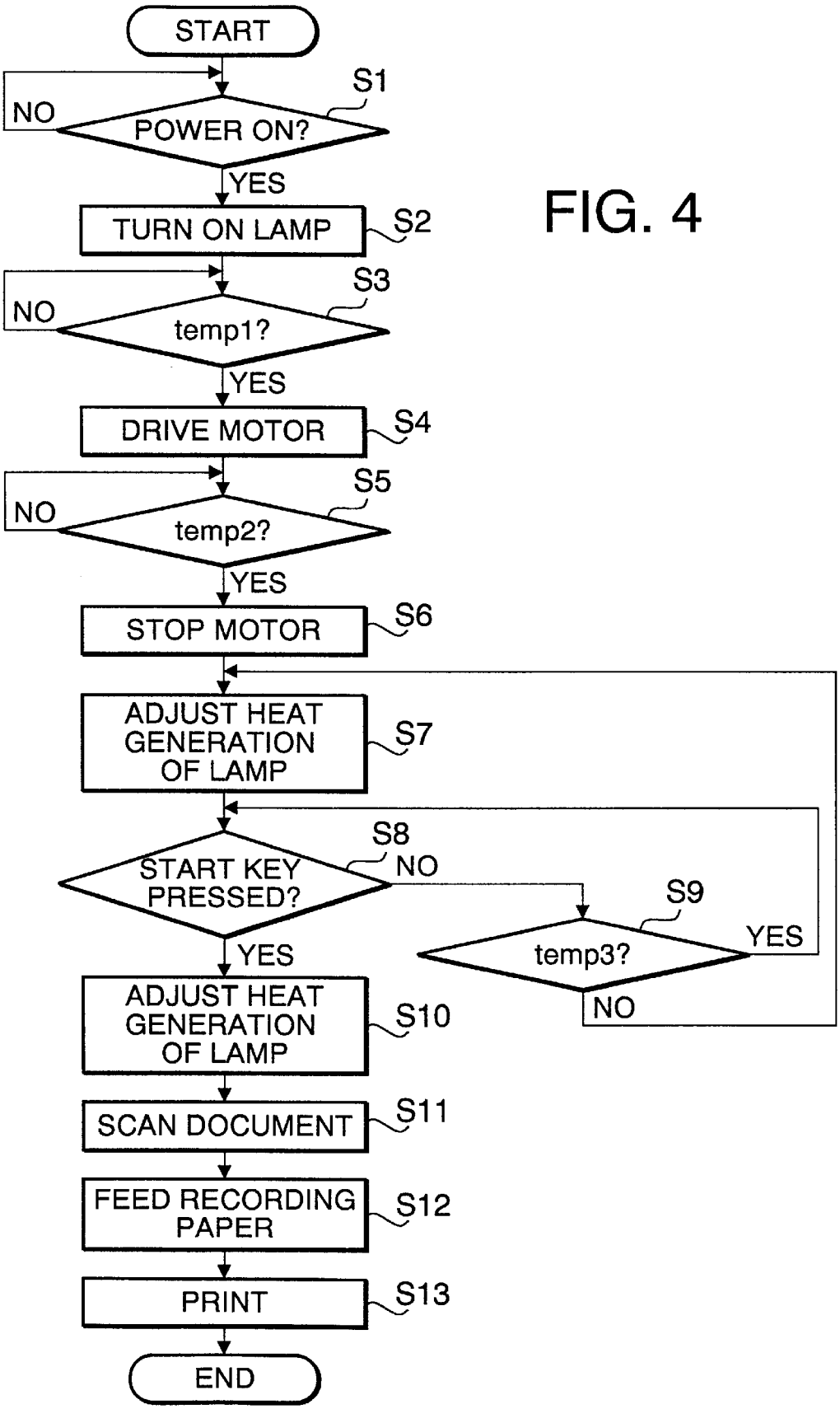

The operation of the facsimile machine 1 from the time it is supplied with power to the time it performs copying will now be described in detail with reference to the time line in FIG. 3 and the flow chart of FIG. 4. This operation is executed based on programs stored in the ROM 12, and performed under the control of MPU 11.

At step S1 the machine (or MPU) determines whether or not power has been turned on; if not, the program loops back in a stand-by mode, but when power is turned on, the machine 1 performs an initialization procedure and starts warming up.

At step S2 the lamp 101*a* is illuminated, and the fuser 100 is heated.

The machine 1 then waits until the temperature of the fuser unit 100 reaches a predetermined motor rotation temperature level (temp 1). Specifically at step S3 the machine 1 determines whether the temperature detected by the temperature sensor 110 has reached temp 1 (80° C., for example); if not, the program loops back until the temperature reaches the predetermined temp 1.

At step S4 the motor M is rotated, and a photosensitive drum 30 pre-rotation operation is begun. This pre-rotation operation includes cleaning the surface of the drum 30, and collecting the toner gathered in the memory removing brush 91 at the developing roller 63 via the photosensitive drum 30.

At step S5 it is determined whether or not the temperature detected by the temperature sensor 110 has reached a warm-up completion temperature (temp 2). In the present embodiment, the warm-up completion temperature is set at 120° C. If not, the program loops back and repeats step S5 until the detected temperature reaches temp 2.

At step S6 the rotation of the motor M is stopped, and the pre-rotation operation is complete. In other words, the warming-up procedure is complete.

Next, at step S7 the heat generation of the lamp 101*a* is adjusted such that the temperature of the fuser unit 100 reaches a pre-determined stand-by temperature (temp 3). In the present embodiment, the stand-by temperature temp 3 is 140° C.

At step S8 it is determined whether or not the start key 16*c* has been pressed. If the key is pressed, the program advances to step S10. If not, the program advances to step S9.

At step S9 it is determined whether or not the temperature detected by the temperature sensor 110 is equivalent to the stand-by temperature temp 3. If so (step S9, YES) then the program returns to step S8; if not, then the program returns to step S7. It should be noted that the stand-by temperature temp 3 should be set at a temperature that allows the temperature of the fuser unit 100 to rise to the fusing temperature temp 5, enabling the image data to be properly recorded on the recording sheet 71, during the time period between when the recording sheet leaves the cassette 70 (after the start key 16*c* has been pressed) and reaches the fuser unit 100.

At step S10, heat generation of the lamp 101*a* is adjusted in order to raise the fuser temperature to a fusing temperature temp 5. In the present embodiment the fusing temperature temp 5 is set at 160° C.

At step S11 an image of the document is scanned-in by the scanning unit 14.

At step S12 the motor M is rotated, and a sheet of recording paper 71 is transported from the paper cassette 70 towards the photosensitive drum 30.

At step S13 the image data is recorded onto the recording sheet 71 by the recording unit 15. When this happens, the temperature detected by the temperature sensor 110 has reached the fusing temperature temp 5. In other words, when the start key 16 *c*is pressed thereby inputting a print command signal to the machine, the temperature of the fuser unit 100 is raised from the stand-by temperature temp 3 to the fusing temperature temp 5 during the time period between which the recording sheet 71 moves from the paper cassette 70 to the fuser unit 100.

Figure 5:
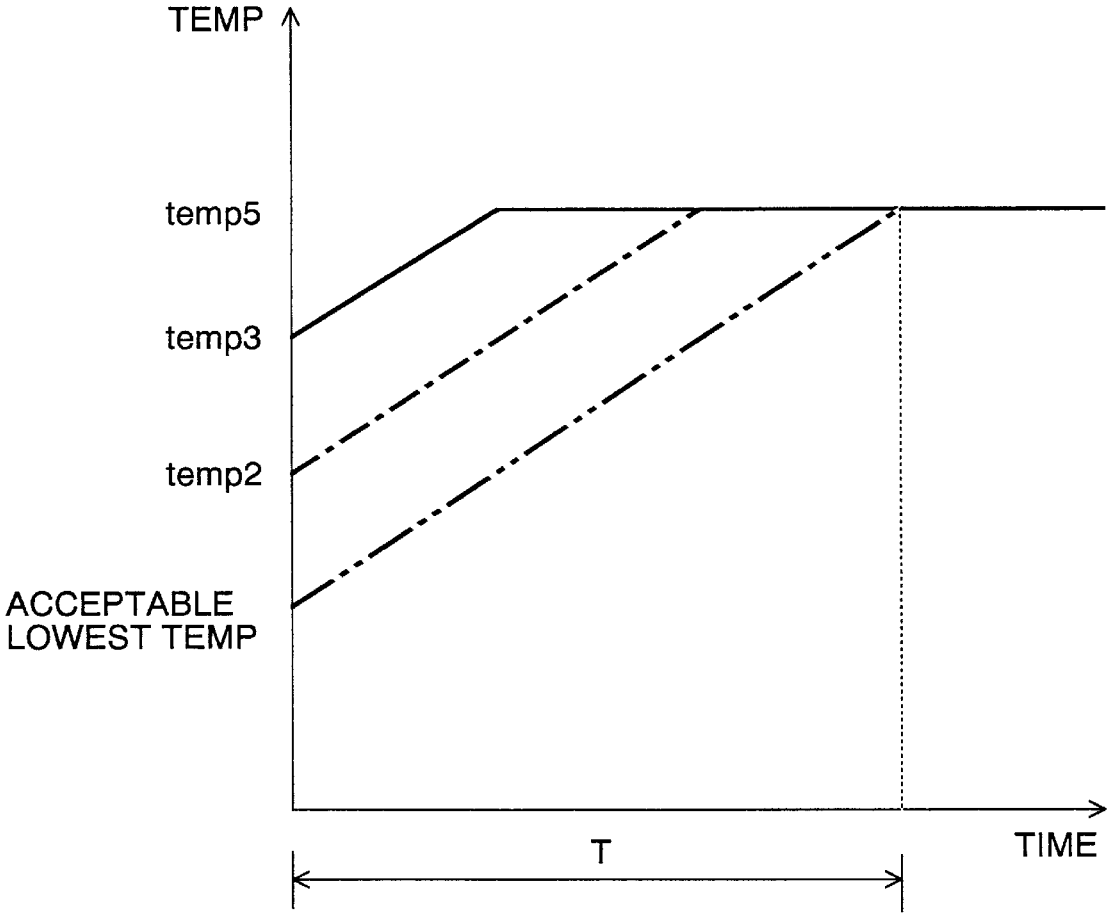
FIG. 5 a temperature characteristics chart showing the relationship between time and temperature after power is turned on in the fax machine of FIG. 1.

Next, a method of calculating the minimum warming up end temperature temp 2 will be described with reference to temperature/time graph shown in FIG. 5.

The "minimum temperature" is herein defined as the lowest temperature that would permit the fuser to reach the fusing temperature temp 5 during the interval T from the start of motor M rotation upon depression of the start key 16*c*, which causes the recording sheet 71 to be drawn from the paper cassette 70 towards the photosensitive drum 30, to the moment when the front edge of the recording sheet 71 reaches the fuser unit 100.

The minimum temperature for temp 2 is derived based on the relationship between time T and the fusing temperature temp 5. Specifically, the heating capability "a" of the lamp 101*a* (defined by the slope of the heating characteristic curve in FIG. 5—more specifically, the amount of temperature increase for each unit of time), time T, the warming up completion temperature t2 and the fusing temperature temp 5 combine to form the following function.

$$\text{temp } \mathbf{5} - \text{temp } \mathbf{2} \leq a*T \quad (1)$$

Since the heating slope "a" depends on the heating characteristics of the lamp 101*a*, it is a constant value. Additionally, since time T is defined as the amount of time it takes for the recording sheet 71 to move from the paper cassette 70 until the tip of the paper reaches the fusing unit 100, time T is also constant.

Thus the minimum temperature temp 2 can be defined as:

$$\text{temp } \mathbf{2} = \text{temp } \mathbf{5} - a*T \quad (1)$$

As thus described in the foregoing, the present embodiment can demonstrate the following advantages.

1) The warm-up completion temperature temp 2 of the fuser unit 100 is set to a temperature lower than the stand-by temperature t3. This reduces the warm-up period (the time required between the moment power is supplied to the machine until the completion of the warming up operation), and also reduces the amount of electric power the machine consumes for the warm-up operation.

2) After the warm-up operation is completed, the temperature of the fuser unit 100 is raised from the warm-up completion temperature temp 2 to the stand-by temperature temp 3. This enables the fuser unit 100 to be brought to the fusing temperature 5 during the time period T from when the recording sheet 71 exits the paper cassette 70 to the moment the tip of the recording sheet 71 meets the fuser unit 100 with great reliability even when the start key 16*c* is pressed while the machine is in stand-by mode. Accordingly, even if the start key 16*c* is pressed during the stand-by condition, the machine can properly perform the printing operation.

3) The minimum allowable warm-up end temperature temp 2 is calculated based on the amount of time T needed for the recording sheet 71 to move from the paper cassette 70 to the fuser unit 100, the fusing temperature temp 5 of the fuser unit 100, and the heating capability (the heating slope "a") of the lamp 101*a*. Thus, as long as the warm-up end temperature temp 2 of the fuser unit 100 is equal to or above the minimum temperature, the fuser unit 100 can be reliably brought to the fusing temperature temp 5 before the tip of the recording sheet 71 reaches the fuser unit 100, thus making the fusing/fixing of the transferred toner image to the recording sheet 71 more reliable.

It should be noted that the present invention is not limited to the illustrated and described configuration. For example, the following modifications can be made to the embodiment without departing from the spirit and scope of the present invention.

In the above embodiment, the pre-rotation operation is initiated when the temperature detected by the temperature sensor 110 reaches the rotation start temperature temp 1 of the motor M, and ended when the detected temperature reaches the warm-up end temperature temp 2. It is possible, however, to arrange the present invention such that the pre-rotation operation ends at a different point in time as long as that point is before recording of the image data begins.

Additionally, it should be noted that when the present invention is employed in a facsimile machine to receive facsimile data from a remote device, the processing step of detecting whether or not the start key 16*c* has been pressed can be replaced by a step of determining whether or not facsimile data has been received at MPU 11.

It is also satisfactory that when the start key 16*c* is pressed or a print command is sent to the MPU 11 after power is turned on but before the machine has completed the warm-up operation, the image of the document scanned-in by the scanning unit 14 may be temporarily stored in image memory 18. Similarly, if facsimile reception takes place (i.e., facsimile data is input to MPU 11) during the warm-up period (before the warm-up operation ends after energization of the image forming apparatus), the received image data may also be temporarily stored in image memory 18. Still further, once heating of the fuser unit 100 is completed, the recording sheet 71 may be advanced from the paper cassette 70 and the image recorded on the recording sheet 71 without stopping the rotation of the motor M.

The illustrated and described image forming apparatus is disclosed in Japanese Patent Application No. 11-197406 filed on Jul. 12, 1999 in JPO, the instant application claims priority of this Japanese Patent Application, and the entire disclosure thereof is incorporated herein by reference.

What is claimed is:

1. An electro-photographic type image forming apparatus comprising:

a fuser;

a heating unit that heats the fuser;

a temperature detection unit that detects the temperature of the fuser; and a control unit that stops performing a warm-up operation when the temperature of the fuser reaches a warm-up completion temperature (Temp 2) that is lower than a stand-by temperature;

wherein Temp 2 satisfies the relationship $$\text{Temp } 5 - a*T \leqq \text{Temp } 2 \leqq \text{Temp } 5,$$

where Temp 5 is a fusing temperature, a is a heating capability of the heating unit, and T is a time interval between issuance of a print command and a moment when a front end of a recording sheet reaches the fuser.

2. The image forming apparatus of claim 1 wherein the control unit causes the heating unit to heat the fuser to the stand-by temperature after the fuser reaches the warm-up completion temperature.

3. The image forming apparatus of claim 1 wherein the control unit causes the heating unit to heat the fuser such that the temperature of the fuser becomes a fusing temperature during a time period between giving of a print command signal and a moment of front end of a recording sheet reaches the fuser.

4. The image forming apparatus of claim 3 wherein the print command signal is given by pressing of a start key.

5. The image forming apparatus of claim 3 wherein the print command signal is given by reception of facsimile data from a remote device.

6. The image forming apparatus of claim 3 wherein the warm-up completion temperature is about 120° C., the stand-by temperature is about 140° C. and the fusing temperature is about 160° C.

7. An image forming apparatus comprising:

a photosensitive drum;

an exposure unit that forms an electrostatic latent image on the photosensitive drum;

a developer that forms a toner image by applying toner to the electrostatic latent image;

a transfer unit that transfers the toner image to a recording sheet;

a fuser that fuses the transferred toner image to the recording sheet;

a heater that heats the fuser;

a temperature detection unit that detects the temperature of the fuser; and a control unit that controls the heating unit based on the temperature detected by the temperature detection unit wherein the control unit terminates a warm-up operation when the temperature of the fuser reaches a warm-up completion temperature (Temp 2) that is lower than a stand-by temperature;

wherein Temp 2 satisfies the relationship $$\text{Temp } 5 - a*T \leqq \text{Temp } 2 \leqq \text{Temp } 5,$$

where Temp 5 is a fusing temperature, a is a heating capability of the heating unit, and T is a time interval between issuance of a print command and a moment when a front end of a recording sheet reaches the fuser.

8. The image forming apparatus of claim 7 wherein the control unit causes the heater to heat the fuser to the stand-by temperature after the fuser reaches the warm-up completion temperature.

9. The image forming apparatus of claim 7 wherein the control unit causes the heater to heat the fuser such that the temperature of the fuser becomes a fusing temperature during a time period between giving of a print command signal and a moment a tip of the recording sheet reaches the fuser.

10. The image forming apparatus of claim 9 further including an operation unit having a start key, and wherein the print command signal is given by pressing the start key.

11. The image forming apparatus of claim 9 further including a network control unit, and wherein the print command signal is given by detection of a facsimile received by the network control unit.

12. A warm-up method in an image forming apparatus comprising the steps:

(A) starting a warm-up operation upon energization of the image forming apparatus;

(B) activating a heating unit that heats a fuser, and starting rotation of a motor that rotates a photosensitive body;

(C) detecting the temperature of the fuser;

(D) determining whether or not the detected temperature of the fuser has reached a warm-up completion temperature (Temp 2) that is lower than a stand-by temperature; and (E) stopping rotation of the motor and ending the warm-up operation when it is determined at step (D) that the temperature of the fuser has reached the warm-up completion temperature;

wherein Temp 2 satisfies a relationship $$\text{Temp } 5 - a*T \leqq \text{Temp } 2 \leqq \text{Temp } 5,$$

where Temp 5 is a fusing temperature, a is a heating capability of the heating unit, and T is a time interval between issuance of a print command and a moment when a front end of a recording sheet reaches the fuser.

13. The warm-up method of claim 12 further including the step of (F) heating the fuser to the stand-by temperature after step (E).

14. The warm-up method of claim 13 further including the step of (G) heating the fuser to a fusing temperature from the stand-by temperature according to printing instructions.

15. The warm-up method of claim 14 wherein an amount of time required for step (F) is less than an amount of time between giving of a print command signal and arrival of a tip of a recording sheet at the fuser.

16. The warm-up method of claim 15 wherein the print command signal is given by pressing a start key of the image forming apparatus.

17. The warm-up method of claim 15 wherein the print command signal is given by detection of facsimile signal received from a remote device.

18. The warm-up method of claim 14 wherein the warm-up completion temperature is about 120° C., the stand-by temperature is about 140° C. and the fusing temperature is about 160° C.

* * * * *